United States Patent [19]

Gaudino

[11] Patent Number: 4,561,243

[45] Date of Patent: Dec. 31, 1985

[54] SPINNING OR TWISTING MACHINE HAVING DEVICES FOR THE SIMULTANEOUS AUTOMATIC REMOVAL OF ALL COPS

[75] Inventor: Piero Gaudino, Cossato, Italy

[73] Assignee: Officine Gaudino di P. Gaudino & C.S. a.s., Cossato, Italy

[21] Appl. No.: 561,075

[22] Filed: Dec. 14, 1983

[30] Foreign Application Priority Data

Dec. 12, 1982 [IT] Italy ..... 68502 A/82

[51] Int. Cl.[4] ..... D01H 9/04

[52] U.S. Cl. ..... 57/274; 57/275

[58] Field of Search ..... 57/266, 273–275

[56] References Cited

U.S. PATENT DOCUMENTS 3,827,227 8/1974 Pray et al. ..... 57/274

3,905,184 9/1975 Takai et al. ..... 57/274

FOREIGN PATENT DOCUMENTS 2086195 12/1971 France .

2112519 6/1972 France .

*Primary Examiner*—John Petrakes

*Attorney, Agent, or Firm*—Barnes & Thornburg

[57] ABSTRACT

A ring spinning or twisting machine is provided with a cop-removal device arranged to automatically remove all full cops simultaneously from the spindle row of the machine and to replace them with empty cop spools. The cop-removal device comprises a plurality of take-up members each associated with a respective spindle and movable only in the axial direction thereof, and a conveyor extending parallel to the spindle row and arranged to transport the empty spools and full cops respectively to and from the machine. The conveyor has a first row of pins arranged to receive full cops after they have been removed from the spindles by the take-up members, and a second row of pins for carrying empty spools to be picked up by the take-up members and placed on the spindles. The conveyor is movable horizontally transverse the spindle row to bring the two rows of pins into coaxial alignment with the axes of the spindles when required.

14 Claims, 5 Drawing Figures

SPINNING OR TWISTING MACHINE HAVING DEVICES FOR THE SIMULTANEOUS AUTOMATIC REMOVAL OF ALL COPS

The present invention relates to improvements in spinning or twisting machines having devices for the simultaneous automatic removal of all cops.

Spinning or twisting machines are already known that incorporate devices which are arranged to automatically remove the full cops and replace them with empty spools, and which effect the take-up of all the cops simultaneously.

One such device comprises a conveyor belt which extends parallel to the row of spindles and is located in front of this row in a position beneath the bench that supports the spindles. This device also includes take-up members for the cops which are arranged to take up the latter (at the end of each cop-forming process), remove them vertically from the spindles and place them on pins carried by the said conveyor belt. The take-up members then grasp the empty spools which are located on the pins of a row parallel to the row of cop-receiving pins of the conveyor belt, lift them and carry them above the spindles and lower them onto the spindles themselves from above. At the end of this operation, the take-up members return to their upper waiting position before the start of the subsequent cop-forming process.

This system has the disadvantage of creating, in correspondence with the front part of the spinning or twisting machine, an obstruction which makes access to the spindles difficult, and furthermore the support and maneuvering structure for the take-up members, which are subject to not inconsiderable forces during the lifting, effects movements in a vertical sense as well as transverse movement relative to the length of the machine. This makes it difficult to effect a correct and accurate alignment of the take-up members with the spindles and with the pins of the conveyor belt and, as a result causes difficulties with the take-up and discharge of the full cops and the empty spools.

The object of the present invention is to avoid these disadvantages and to provide a spinning or twisting machine with a device for effecting the simultaneous removal of all the cops, said device being of the type having conveyor means extending longitudinally of the machine which serves for the removal of full cops from the latter and for the supply of empty spools and which include for this purpose two rows of pins parallel to each other, the device further having take-up members for removing the cops simultaneously from all the spindles and depositing them on the conveyor means for taking up from the latter the same number of empty spools and locating them simultaneously onto the said spindles, the device being characterized in that the take-up members are coaxial with their respective spindles and are movable along the axes of these spindles, and furthermore in that the conveyor means are located above the drafting or feeding zone and are movable transverse the length of the machine between a position in which it is outside the vertical path of the take-up members and two other positions, namely a first position in which the plane containing the axes of the pins intended to receive the cops coincides with the vertical plane containing the axes of the spindles, and a second position in which this vertical plane coincides with the plane containing the pins intended to carry all the empty spools.

Further characteristics and advantages of the invention will emerge from the following description with reference, purely by way of non-limiting example, to one practical embodiment illustrated in the appended drawings, in which.

Figure 1:
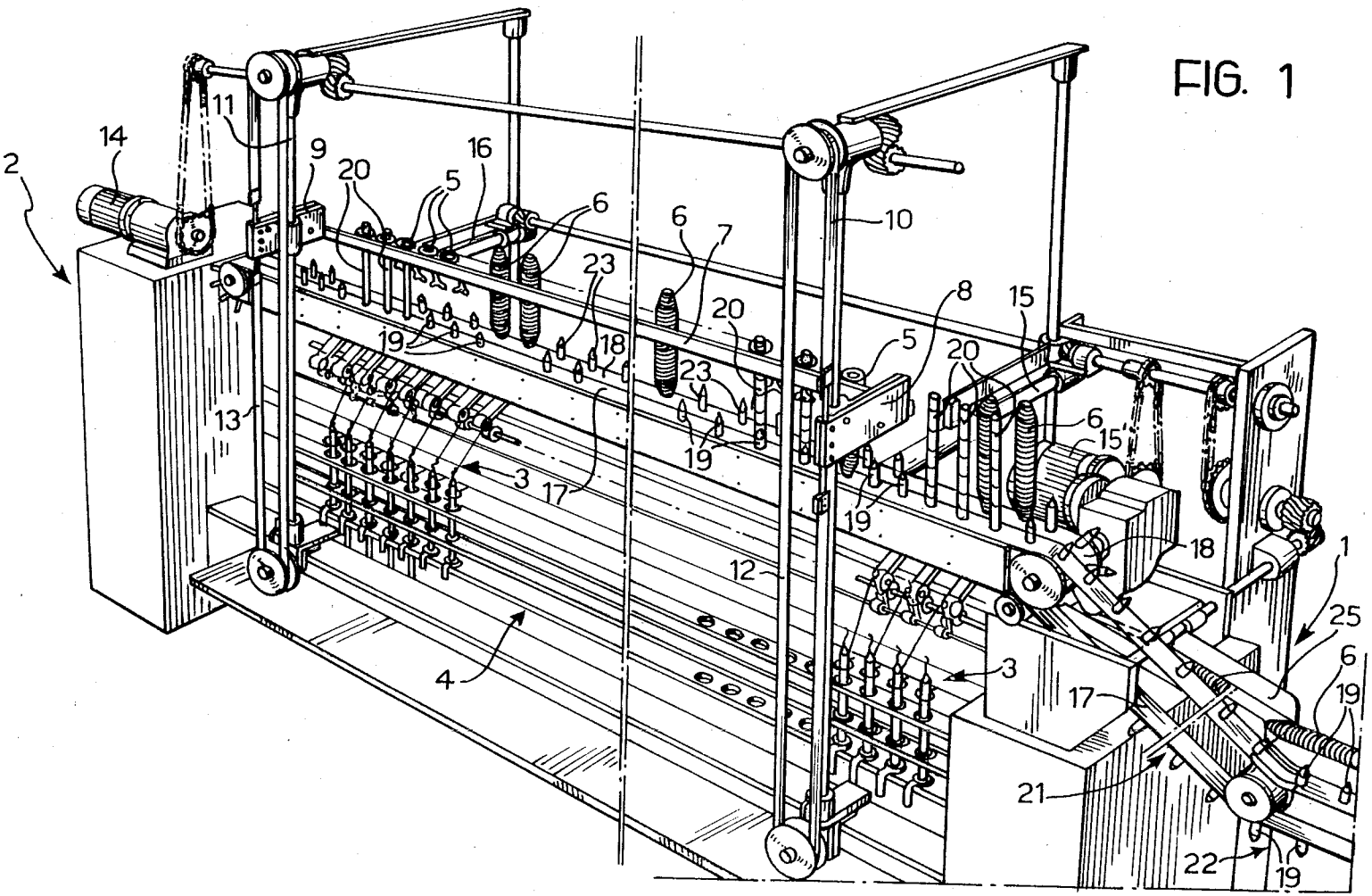
FIG. 1 is a schematic perspective view of a spinning or twisting machine according to the invention.
Figure 2:
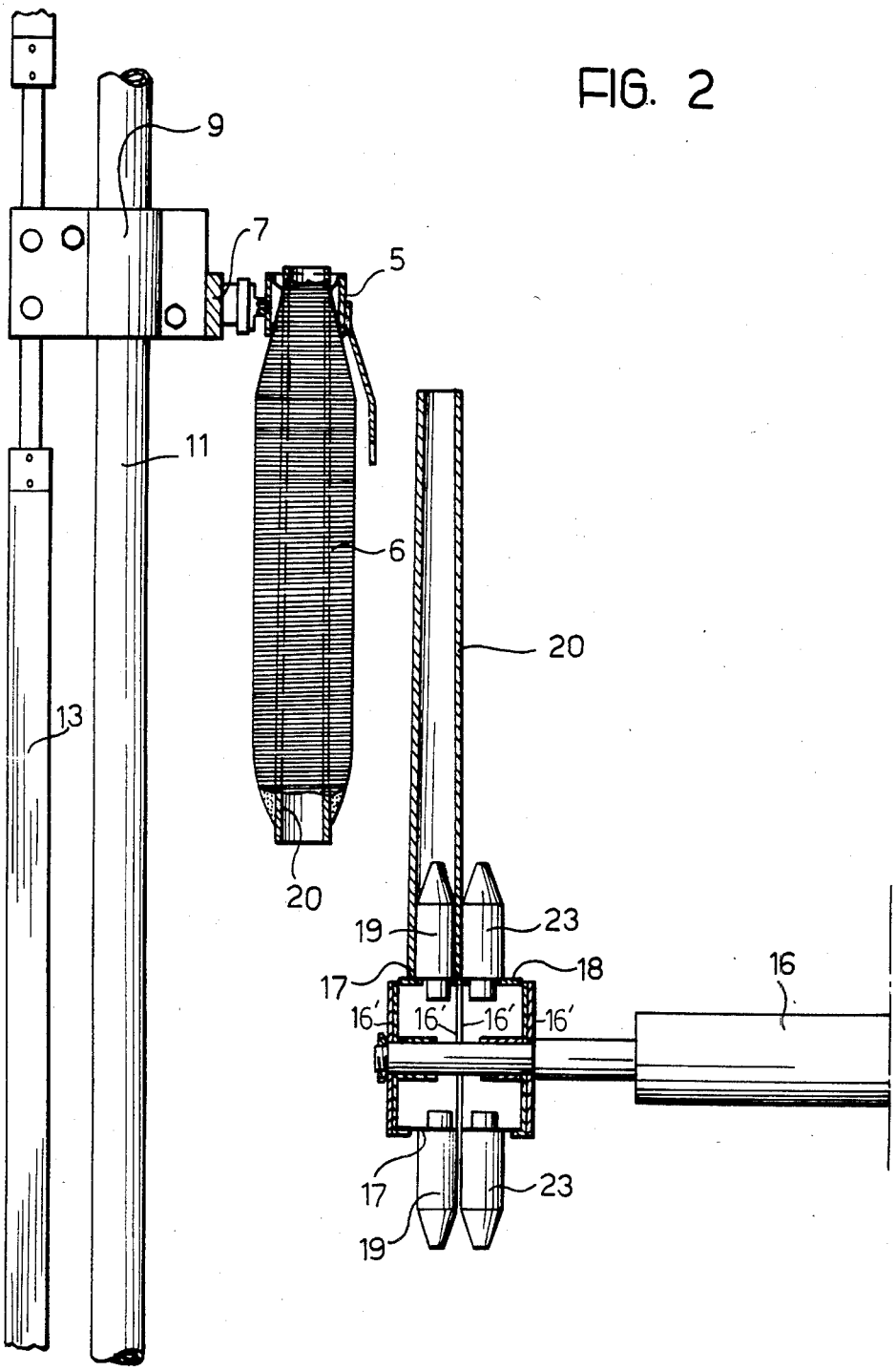
FIG. 2 is a a partial transverse section on a greatly enlarged scale.
Figure 3:
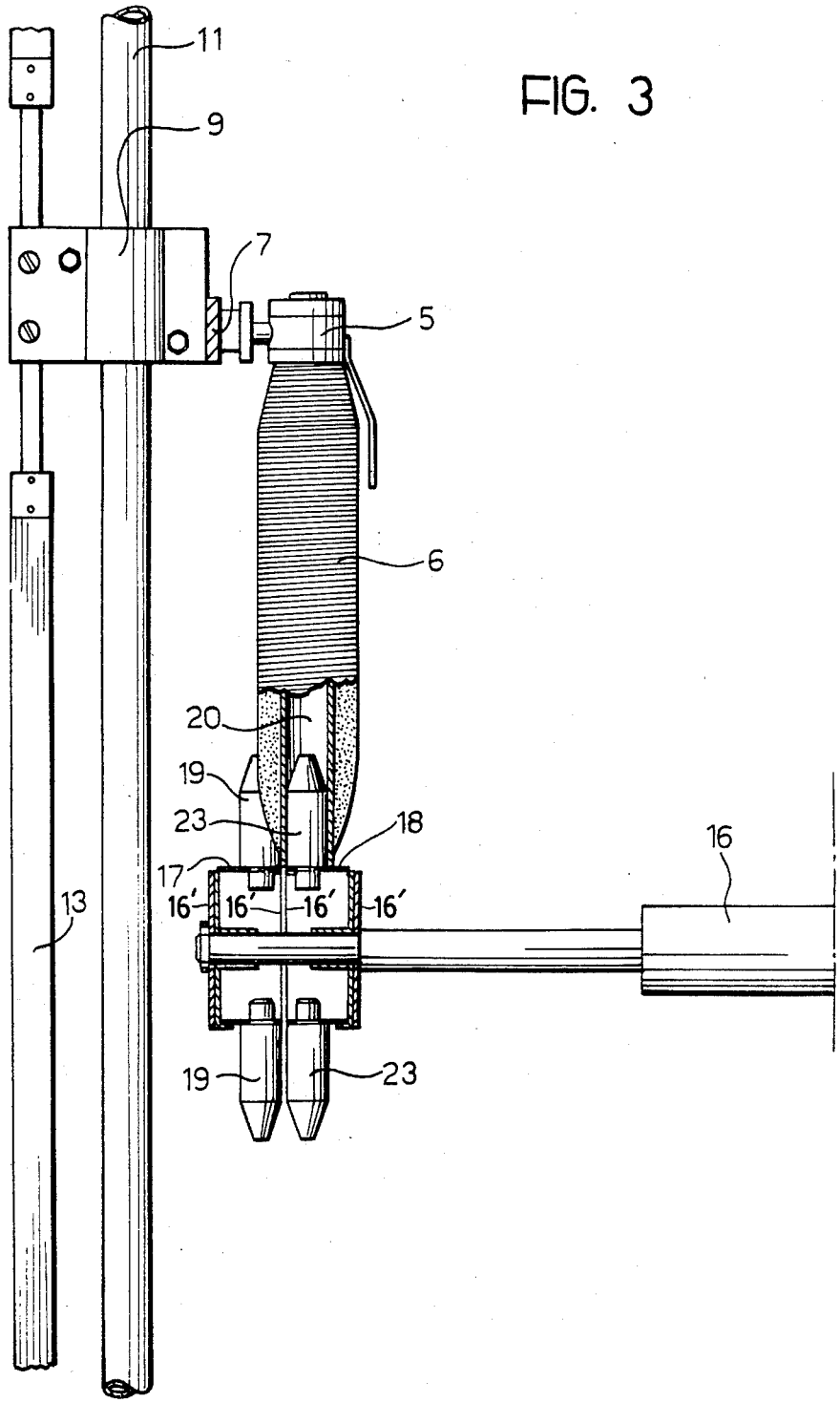
FIGS. 3 and 4 are sections similar to that of FIG. 2, illustrating other operative positions of the automatic removal device with which the machine according to the invention is provided.
Figure 4:
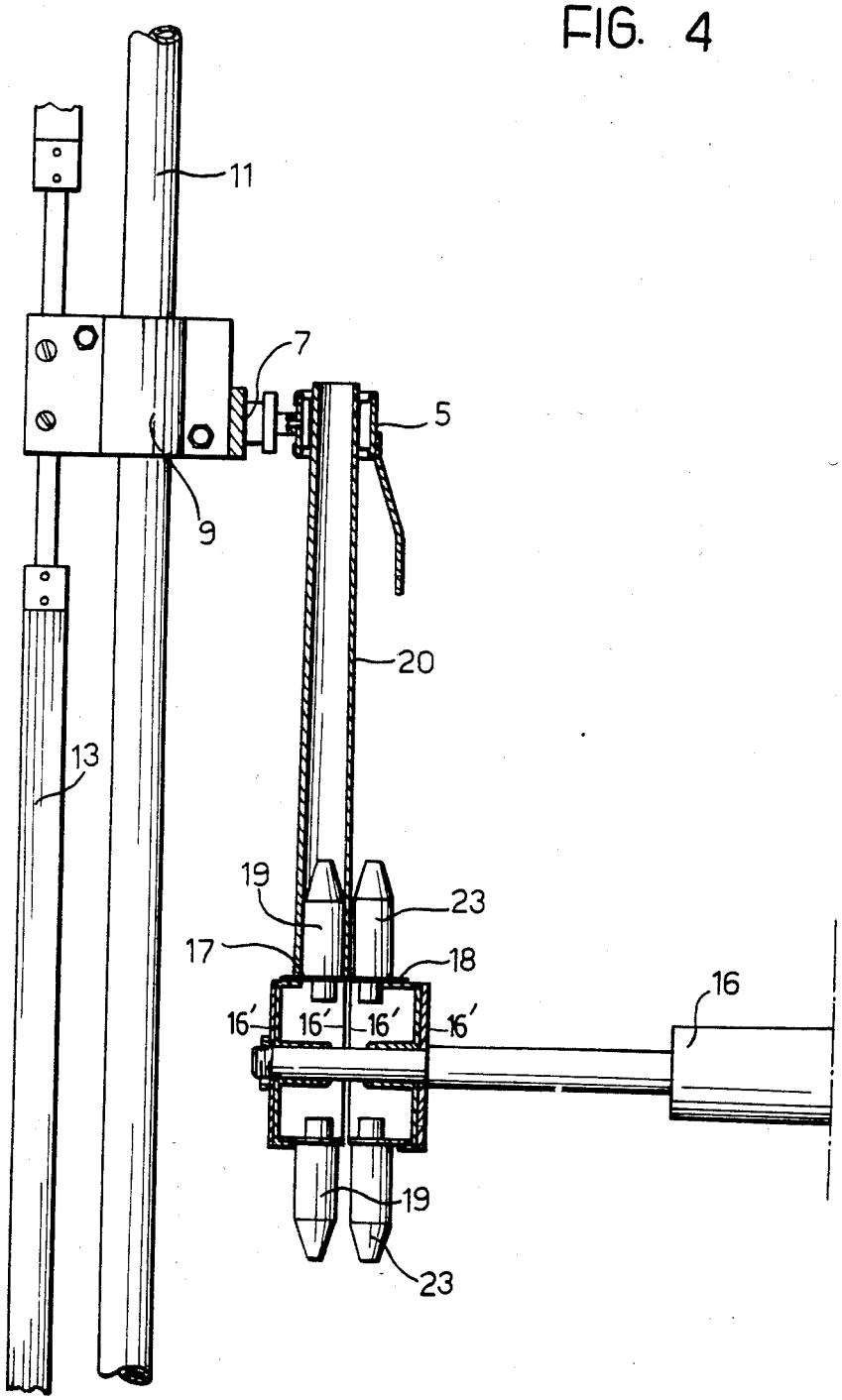

In the drawings, the opposite heads of the machine are indicated 1 and 2 respectively and the row of spindles rotatably mounted on an angle bracket 4 is indicated 3.

In the example illustrated, the take-up members are constituted by bushes 5 containing internal inflatable sleeves for enabling full cops 6 or spools inserted into the bushes themselves to be grasped. These bushes 5 are cantilevered on a longitudinal bar 7 the ends of which are fixed to supports 8 and 9 mounted for sliding movement on vertical guides 10 and 11, respectively located close to the heads 1 and 2. The supports 8 and 9 are respectively connected to endless belts or chains 12 and 13 which in order to effect vertical movement of the bar 7 are arranged to be driven by a motor 14 that is synchronized with other drive members of the machine.

The sleeve located within the bushes 5 communicate with a pressurized air supply through flexible tubes and a valve controlled by a timer (not illustrated). At the tops of the opposing heads 1 and 2 of the machine are transverse guides (not illustrated). Spaced inward from the opposing heads 1 and 2 are lead screws 15 and 16. Under the action of lead screws 15 and 16 respectively, a travelling bridge 16' is slidable transverse to the spindles 3 (FIGS. 1–4). The Traveling bridge 16' carries a conveyor including two continuous belts 17 and 18 respectively which are preferably metallic. A motor 15' drives the lead screws 15 and 16 to move the travelling bridge 16' and thus move the conveyor belts 17 and 18 transverse to the spindles 3. The belt 17 carries a longitudinal row of pins 19 located at the same spacing as the axes of the spindles 3 and, naturally, as that of the bushes 5 coaxial with the spindles. The pins of this row are intended to carry the empty spools 20 and the belt 17 has a descending portion 21 which terminates with a horizontal portion 22. The belt 18 extends parallel to the belt 17 and adjacent that side of the latter away from the front of the machine. The belt carries pins 23 which are disposed at intervals similar to those of the pins 19 and are intended to receive the full cops 6 from above.

The travelling bridge structure carrying the conveyor is movable transverse the length of the machine so as to be able to occupy three positions as follows:

a first position (illustrated in FIG. 2) in which it is located outside the vertical path traversed by the bushes 6;

a position (illustrated in FIG. 3) in which the plane containing the axes of the pins 19 carried by the belt 17 coincides with the plane containing the common axes of the bushes 5 and the spindles 3 and, finally, a position (illustrated in FIG. 4) in which this plane coincides with the vertical plane containing the axes of the pins 23 carried by the belt 18.

The operation of the structure described above is as follows:

At the end of each cop-forming operation, the take-up members constituted by the bushes 5 (which are held waiting in their upper end-of-movement position on the guides 10 and 11) are lowered to engage the full cops located on the spindles, and are then returned to their starting position. The next phase consists of the advance of the structure supporting the conveyor belts 17 and 18 towards the front side of the machine until the plane containing the axes of the pins 23 projecting from the belt 18 coincides with the plane containing the axes of the spindles from which the cops have previously been taken. The bar 7 is then lowered in order to locate the cops 6 pins 23 and thereafter the bar 7 is raised, this latter movement being preceded by the deflation of the internal sleeves in the bushes 5 (in order to allow their disengagement from the cops).

At this point the conveyor support having the belts 17 and 18 withdraws in the direction away from the front of the machine so as to align the vertical plane containing the axes of the pins 19 carrying the empty spools, with the plane containing the common axes of the spindles and the corresponding bushes 5.

Now everything is set for the take-up of the spool 20 by the bushes 5 and the transfer of these spools to the spindles 3. This occurs by virtue of the lowering of the bar 7 carrying the take-up members 5 (until the spools 20 are engaged in the latter) followed by the clamping of these latter and the subsequent raising of the bar 7. After the spools 20 have thus been removed from the pins 19, the bar 7 is first lowered again so as to locate the spools 20 on the spindles, and then is finally brought back to the upper starting position after the disengagement of the bushes 5 from the spools themselves. In the meantime conveyor belt 18 advances so as to displace its upper pass in the direction of the arrow 24 and discharge the cops carried by the pins 23 into the chute 25. During the subsequent cop winding process which by now has started, a further series of empty spools is loaded onto the pins 19 of the belt 17 which moves in the opposite direction from that indicated by the arrow 24 in order to bring the spools into the position in which they can be taken up simultaneously by the bushes 4 at the end of the new cop-forming process which is being effected.

Naturally, the principle of the invention remaining the same, the details may be varied widely with respect to that described and illustrated purely by way of example, without thereby departing from the scope of the present invention as defined in the appended claims.

Figure 5:
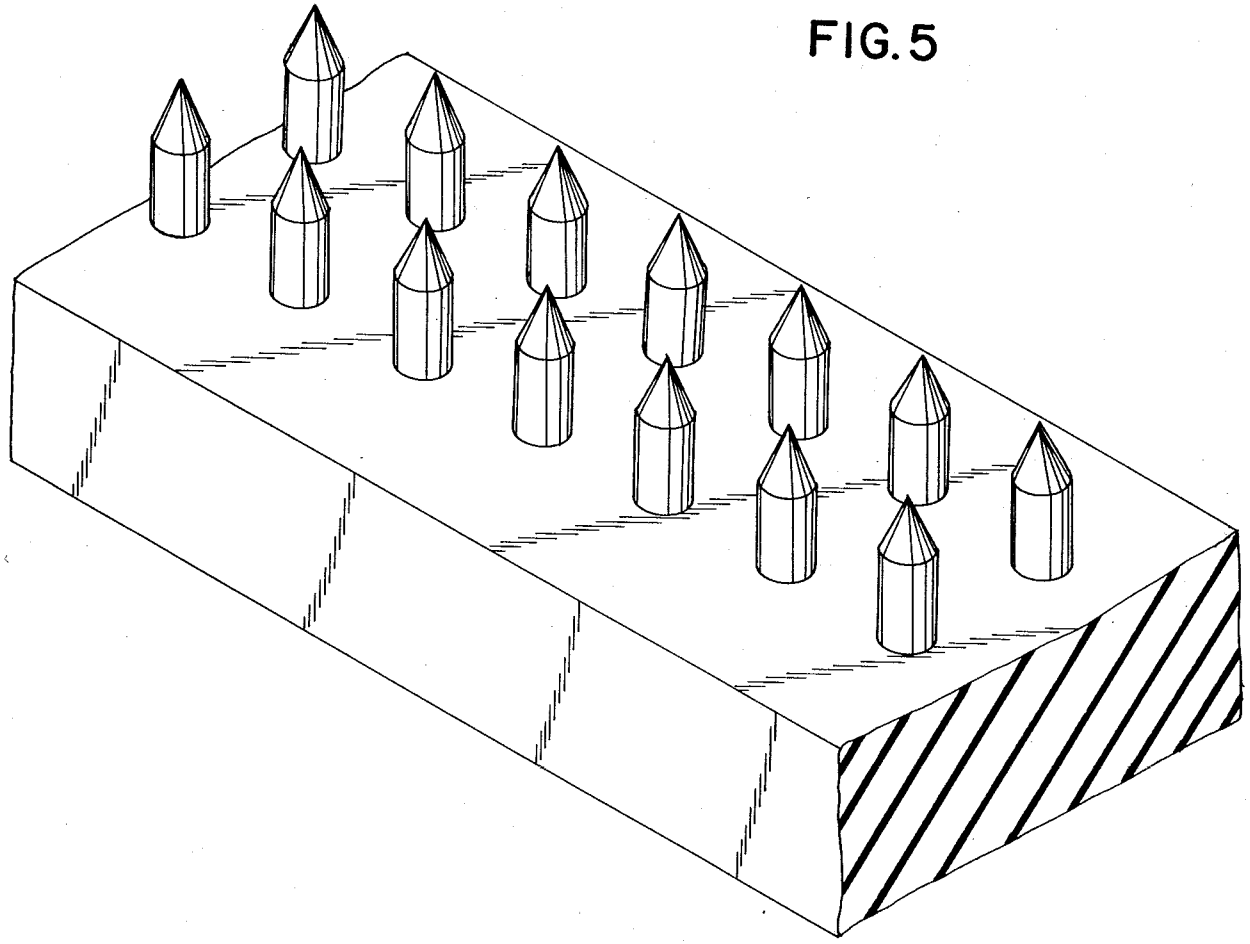
FIG. 5 is a schematic view of an embodiment having a single conveyor belt.

Thus, for example, the conveyor could include a single belt with two longitudinal rows of pins, one comprising pins intended to receive full cops and the other of the pins carrying the empty spools to be located on the spindles. (As shown in FIG. 5.)

In both cases, the structure carrying the belts moves only longitudinally to allow axial alignment of the spools 20 with the bushes 5 and the spindles 3.

I claim:

1. A ring spinning machine comprising:

row of spindles for removably receiving spools;

a cop removal means for simultaneously removing cops in the direction axial to the spindles;

a conveyor means extending longitudinally of the row of spindles having a first row of cop receiving means for receiving cops from said cop removal means and having a second row of cop receiving means for carrying spools;

a conveyor displacement means for displacing the conveyor means transverse to the row of spindles, wherein said conveyor means occupies a first position outside a plane of said spindle axes, a second position in which a plane containing said first row of cop receiving means coincides with the plane of said spindle axes, and a third position in which a plane containing said second row of cop receiving means coincides with the plane of said spindle axes.

2. A ring spinning machine as in claim 1, wherein said conveyor means is carried by a travelling bridge.

3. A ring spinning machine as in claim 2, wherein the conveyor means is a single continuous belt provided with both of said first and second rows of cop receiving means.

4. A ring spinning machine as in claim 3, wherein said first row of pins is mutually staggered longitudinally from said second row of pins.

5. A ring spinning machine as in claim 2, wherein said conveyor means includes two belts adjacent and parallel each other, each said belt having one row of cop receiving means.

6. A ring spinning machine as in claim 5, wherein the cop receiving means are pins.

7. A ring spinning machine as in claim 6, wherein said conveyor displacement means is at least one lead screw attached to the travelling bridge.

8. A ring spinning machine as in claim 7, wherein said belts operate in opposite directions.

9. A ring spinning machine as in claim 8, wherein one of the conveyor belts has a descending portion.

10. A ring spinning machine as in claim 9, including a chute for receiving cops.

11. A ring spinning machine as in claim 10, wherein the cop removal means only move in an axial direction to the spindles.

12. A ring spinning machine as in claim 11, wherein said cop removal means has take-up members for taking up said cops and said spools.

13. A ring spinning machine as in claim 12, wherein there are an equal number of take up members and associated spindles.

14. A ring spinning machine as in claim 13, wherein said take-up members are pneumatic grippers.

* * * * *